US007895814B1

(12) United States Patent
Levins, Sr. et al.

(10) Patent No.: US 7,895,814 B1
(45) Date of Patent: Mar. 1, 2011

(54) CASE LOADER AND METHOD

(75) Inventors: Jack A. Levins, Sr., Candler, NC (US); Kevin S. Willett, Waynesville, NC (US)

(73) Assignee: Milkco, Inc., Asheville, NC (US)

( * ) Notice: Subject to any disclaimer, the term of this patent is extended or adjusted under 35 U.S.C. 154(b) by 0 days.

(21) Appl. No.: 12/043,395

(22) Filed: Mar. 6, 2008

(51) Int. Cl.
*B65B 5/10* (2006.01)

(52) U.S. Cl. ..... 53/475; 53/495; 53/493; 53/543; 53/535; 53/249

(58) Field of Classification Search ..... 53/473, 53/475, 448, 493, 495, 537, 543, 534, 535, 53/247, 249, 250, 251
See application file for complete search history.

(56) References Cited

U.S. PATENT DOCUMENTS

| | | | | | |
|---|---|---|---|---|---|
| 3,452,508 | A | * | 7/1969 | Dzenis | 53/48.1 |
| 3,788,034 | A | * | 1/1974 | Hartness et al. | 53/248 |
| 3,826,382 | A | * | 7/1974 | Zappia | 414/729 |
| 3,984,964 | A | * | 10/1976 | Stoll | 53/543 |
| 3,986,321 | A | | 10/1976 | Hartness et al. | |
| 4,003,185 | A | * | 1/1977 | Goff | 53/496 |
| 4,005,562 | A | | 2/1977 | Vischer | |
| 4,169,342 | A | | 10/1979 | Hartness et al. | |
| 4,211,056 | A | * | 7/1980 | Birk | 53/543 |
| 4,302,919 | A | | 12/1981 | Hartness | |
| 4,343,390 | A | | 8/1982 | Laub, III | |
| 4,428,178 | A | | 1/1984 | Burtoft | |
| 4,446,672 | A | * | 5/1984 | Raudat | 53/448 |
| 4,531,345 | A | * | 7/1985 | Nigrelli et al. | 53/534 |
| 4,570,413 | A | | 2/1986 | Raudat | |
| 4,611,705 | A | * | 9/1986 | Fluck | 414/798.9 |
| 4,754,598 | A | | 7/1988 | Wild | |
| 4,843,797 | A | * | 7/1989 | Butterly et al. | 53/448 |
| 5,241,805 | A | | 9/1993 | Johnson | |
| 5,560,186 | A | | 10/1996 | Raudat | |
| 5,588,282 | A | | 12/1996 | Hartness | |
| 5,622,031 | A | | 4/1997 | Meives | |
| 5,755,074 | A | | 5/1998 | Fetters | |
| 5,813,196 | A | * | 9/1998 | Page et al. | 53/448 |
| 5,862,651 | A | | 1/1999 | Stewart et al. | |
| 6,668,520 | B1 | * | 12/2003 | Wood | 53/260 |
| 6,990,783 | B2 | | 1/2006 | Spatafora et al. | |

* cited by examiner

*Primary Examiner*—Paul R Durand
(74) *Attorney, Agent, or Firm*—Carter, Schnedler & Warnock, P.A.

(57) ABSTRACT

A case loader for forming arrays of articles such as milk jugs carried by a relatively upper supply conveyor to the loading gate of a loading station and dropping the articles into cases delivered by conveyor to the loading station and raised by an elevator up under the loading gate. A conveyor article sensor is employed to ensure the presence of articles on the supply conveyor a sufficient distance upstream to develop sufficient line pressure force for reliable operation. A plurality of cases are loaded at the same time, and an array of case sensors are employed for reliable case position sensing and operation.

16 Claims, 11 Drawing Sheets

CASE LOADER AND METHOD

BACKGROUND OF THE INVENTION

The invention relates generally to case loaders or case packers for loading articles such as bottles or plastic jugs into boxes or cases.

A variety of case loading machines are known. In one general type, articles to be cased are delivered by a relatively upper article supply conveyor to a loading station and are moved onto a horizontal loading gate. At the same time, cases are delivered by a relatively lower case conveyor to and are moved into position over a support table or platform of an elevator, below the loading gate and also part of the loading station. During an operation cycle, the elevator and a case are raised toward the loading gate, which is then opened to allow articles to drop into the case. The elevator is then lowered, and the case is conveyed off.

As a more particular example of a case loading machine of that general type of case loading machine, articles such as bottles or jugs are conveyed to the loading station, by a pair of side-by-side relatively upper article conveyors. The conveyors run continuously, and slide by underneath the articles or cases when the bottles or cases are braked or stopped, such as prior to entering the loading station. The article conveyor stops just short of the loading station, and so the last few feet of travel of the articles to be loaded is over a pneumatically-actuated loading gate, which is essentially a smooth horizontal plate. Force for moving the articles onto the loading gate is provided by backed-up articles which are still on the article conveyor belt as the article conveyor continues to move, known as line pressure force. When articles and cases are in position, the pneumatically-actuated loading gate opens to drop the articles into the cases.

The lower part of the loading station, which handles the cases, includes the elevator which lifts the cases up so that the articles do not have as far to drop, and then lowers the filled cases to be conveyed downstream.

SUMMARY OF THE INVENTION

In one aspect, a case loader for forming arrays of articles and dropping the articles into upwardly open cases is provided. The case loader includes a loading station having an upstream end and a downstream end, a loading gate on which articles are supported prior to being dropped, and an elevator having lowered and raised positions for positioning cases below the loading gate. The loading gate has an entry end and an opposite end. An article supply conveyor includes a moving belt on which articles are carried and delivered to the loading station to be moved on to the loading gate. An article brake is included for holding articles from the article supply conveyor short of the loading station, causing an accumulation of articles on the article supply conveyor and producing line pressure force urging articles towards the loading station. At least one conveyor article sensor is employed to sense the presence of articles on the article supply conveyor a predetermined distance upstream of the loading station to ensure that articles are present on the article supply conveyor the predetermined distance upstream to develop sufficient line pressure force before releasing the article brake to allow articles to move onto the loading gate via the loading gate entry end urged by line pressure force. A case conveyor carries and at least delivers cases to the upstream end of the loading station to be moved into position over the elevator while the elevator is in the lowered position. During operation at least one case is allowed to move into position over the elevator while the elevator is in the lowered position. The elevator is subsequently raised to the raised position before the loading gate is opened to drop articles into the at least one case, and the elevator is subsequently lowered to the lowered position to allow a loaded case to exit via the downstream end of the loading station.

In another aspect, a case loader for forming arrays of articles and dropping the articles into a plurality of upwardly open cases at the same time is provided. The case loader includes a loading station having an upstream end and a downstream end, a loading gate on which articles are supported prior to being dropped, and an elevator sized to support the plurality of cases and having lowered and raised positions for positioning cases below the loading gate. An article supply conveyor includes a moving belt on which articles are carried and delivered to the loading station to be moved on to the loading gate. A case conveyor carries and at least delivers cases to the upstream end of the loading station to be moved into position over the elevator while the elevator is in the lowered position and a case spacing brake is included for holding cases from the case conveyor short of the loading station. In addition, a case stop is included for holding cases within the loading station in position over the elevator. An array of case sensors is employed to ensure that previously-loaded cases are sufficiently on their way exiting via the downstream end of the loading station before the case spacing brake is released to allow the plurality of cases to move into position over the elevator while the elevator is in the lowered position, employed to determine that the plurality of cases are at least nearly in position over the elevator before the case spacing brake is applied to hold subsequent cases short of the loading station, employed to ensure that the plurality of cases are in position over the elevator before the elevator is raised and before the loading gate is opened to drop articles into the plurality of cases, and employed to ensure the trailing end of the last of the plurality of cases has exited the loading station past the case stop before the case stop is engaged to hold the subsequent cases in position over the elevator. During operation the case spacing brake is released to allow the plurality of cases to move into position over the elevator and to be held by the case stop while the elevator is in the lowered position. The elevator is subsequently raised to the raised position before the loading gate is opened to drop articles into the plurality of cases, and the case stop is subsequently released. The elevator is subsequently lowered to the lowered position, and the plurality of cases are allowed to exit via the downstream end of the loading station.

In yet another aspect, a case loader for forming arrays of articles and dropping the articles into upwardly open cases is provided. The case loader includes a loading station having an upstream end and a downstream end, a loading gate on which articles are supported prior to being dropped, and an elevator having lowered and raised positions for positioning cases below the loading gate. The loading gate has an entry end and an opposite end. At least one pneumatic cylinder is located underneath the elevator for raising and lowering the elevator and for serving to provide shock absorbing cushioning as articles are dropped into cases. The at least one pneumatic cylinder has a piston area selected and the pneumatic cylinder is operated at a pressure such that the at least one pneumatic cylinder can raise and support the elevator and empty cases at the raised position, but allows the elevator to move towards the lowered position under the dynamic force of dropped articles even under operating pressure. An article supply conveyor includes a moving belt on which articles are carried and delivered to the loading station to be moved on to the loading gate. A case conveyor carries and at least delivers cases to the upstream end of the loading station to be moved into position over the elevator while the elevator is in the lowered position. During operation at least one case is allowed to move into position over the elevator while the elevator is in the lowered position. The elevator is subsequently raised to the raised position before the loading gate is opened to drop articles into the at least one case and move the elevator at least towards the lowered position. The elevator is subsequently lowered to the lowered position to allow a loaded case to exit via the downstream end of the loading station.

In yet another aspect, a case loader for forming arrays of articles and dropping the articles into upwardly open cases is provided. The case loader includes a loading station having an upstream end and a downstream end, a loading gate on which articles are supported prior to being dropped, and an elevator having lowered and raised positions for positioning cases below the loading gate. The loading gate has an entry end and an opposite end. An article supply conveyor includes a moving belt on which articles are carried in a plurality of lanes and delivered to the loading station to be moved on to the loading gate. An article brake is included for holding articles from the article supply conveyor short of the loading station, causing an accumulation of articles on the article supply conveyor and producing line pressure force urging articles towards the loading station. A plurality of conveyor article sensors corresponding to the plurality of lanes are employed to individually sense the presence of articles on the article supply conveyor in each of the plurality of lanes a predetermined distance upstream of the loading station to ensure that articles are present on the article supply conveyor the predetermined distance upstream in all of the plurality of lanes to develop sufficient line pressure force before releasing the article brake to allow articles to move onto the loading gate in a plurality of lines corresponding to the plurality of lanes via the loading gate entry end urged by line pressure force. A case conveyor carries and at least delivers cases to the upstream end of the loading station to be moved into position over the elevator while the elevator is in the lowered position. During operation at least one case is allowed to move into position over the elevator while the elevator is in the lowered position. The elevator is subsequently raised to the raised position before the loading gate is opened to drop articles into the at least one case. The elevator is subsequently lowered to the lowered position to allow a loaded case to exit via the downstream end of the loading station.

In yet another aspect, a method of forming arrays of articles and dropping the articles into upwardly open cases at a loading station of the type having an upstream end and a downstream end, and including a loading gate on which articles are supported prior to being dropped, the loading gate having an entry end and an opposite end, and an elevator having lowered and raised positions for positioning cases below the loading gate is provided. The method includes the steps of employing an article supply conveyor including a moving belt on which articles are carried to deliver articles to the loading station; conveying cases to the upstream end of the loading station; holding articles from the article supply conveyor short of the loading station, causing an accumulation of articles on the article supply conveyor and producing line pressure force urging articles towards the loading station; and effecting a cyclical sequence of operations by ensuring that articles are present on the article supply conveyor a predetermined distance upstream to develop sufficient line pressure force before releasing articles to move onto the loading gate via the loading gate entry end urged by line pressure force, allowing at least one case to move into position over the elevator while the elevator is in the lowered position, subsequently raising the elevator to the raised position, and subsequently opening the loading gate to drop articles into the at least one case, and subsequently lowering the elevator to the lowered position and allowing a loaded case to exit via the downstream end of the loading station.

In yet another aspect, a method of forming arrays of articles and dropping the articles into a plurality of upwardly open cases at a loading station of the type having an upstream end and a downstream end, and including a loading gate on which articles are supported prior to being dropped, and an elevator having lowered and raised positions for positioning cases below the loading gate is provided. The method includes the steps of conveying articles to the loading station; conveying cases to the upstream end of the loading station; and effecting a cyclical sequence of operations by moving articles onto the loading gate, ensuring that previously-loaded cases are sufficiently on their way exiting via the downstream end of the loading station before releasing a case spacing brake to allow the plurality of cases to move into position over the elevator while the elevator is in the lowered position, determining that the plurality of cases are at least nearly in position over the elevator before applying the case spacing brake to hold subsequent cases short of the loading station, ensuring that the plurality of cases are in position over the elevator before subsequently raising the elevator to the raised position, and subsequently opening the loading gate to drop articles into the plurality of cases, and subsequently lowering the elevator to the lowered position and allowing the loaded plurality of cases to exit via the downstream end of the loading station, and ensuring that the trailing end of the last of the plurality of cases has exited the loading station past a case stop before engaging the case stop to hold the subsequent cases in position over the elevator.

DETAILED DESCRIPTION

Figure 1:
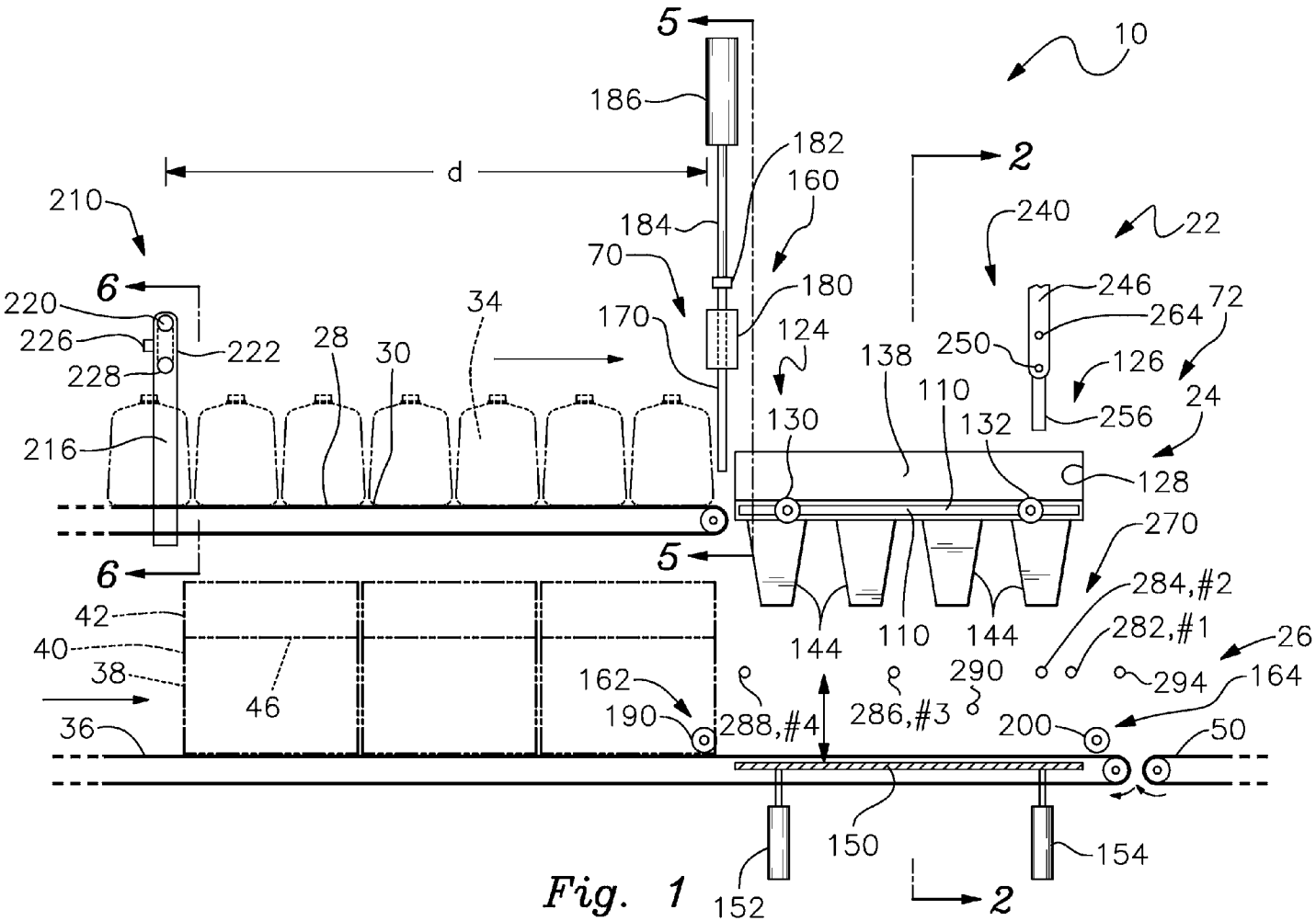
FIG. 1 is a side elevational view of a case loader embodying the invention, in a somewhat schematic representation, but not showing a programmable controller portion thereof (shown in FIG. 8)

Referring initially to FIGS. 1-4, a case loader 20 embodying the invention includes a loading station 22 having upper 24 and lower 26 portions, a relatively upper article supply conveyor 28 including modular conveyor belts 30 and 32 (FIGS. 1, 5, 6 and 7) on which articles in the representative form of one-gallon plastic milk jugs 34 are carried and delivered to the loading station 22. Each of the modular conveyor belts 30 and 32 of the article conveyor 28 is a Rexnord style flat top chain, such as an "880 series" chain. The case loader 20 additionally includes a relatively lower case conveyor 36 which carries and at least delivers cases 38 to the loading station 22. The representative cases 38 are made of corrugated cardboard, and each has a main body 40 and two longitudinally-extending side flaps 42 and 44 differentiated from the main body 40 by fold lines 46 and 48, but no end flaps. The illustrated cases 38 are generally square in plan view, and are sized to each hold four articles. A belt-type downstream conveyor 50 receives loaded cases 38 and conveys the cases 38 for further operations, such as sealing the cases closed (not shown). The case loader 20 additionally includes a programmable controller 60 (FIG. 8) to control operation of the case loader 20.

It will be appreciated that FIG. 1, as well as the other FIGS., is a highly schematic representation which, for clarity of illustration, omits a number of conventional elements, in particular structural supports for the various sensors, brakes and actuators described in detail hereinbelow. In addition, for clarity of illustration, conventional article guides associated with the article supply conveyor 28 are not shown in FIG. 1, but are represented in the cross-sectional views of FIGS. 5 and 6. It will further be appreciated that case loaders embodying the invention may be constructed and adjusted so as to load articles of a variety of sizes, and with fewer or more articles packed into each case.

The loading station 22 more particularly, with reference to the direction of movement of cases 38 into and out of the loading station 22, has an upstream end 70 and a downstream end 72. (Although in the case loader 20 of FIG. 1 the articles 34 move left to right in the same direction as the cases 38, the invention may as well be embodied in case loaders in which the articles 34 and the cases 38 approach the loading station 22 from opposite directions, or even at right angles to each other.)

The article supply conveyor 28 of the particular case loader 20 illustrated and described herein carries and delivers articles to the loading station 22 in a plurality of lanes, in particular, in two lanes 74 and 76. In addition, the case conveyor 36 of the case loader 20 illustrated and described herein delivers cases 38 to the loading station 22 a plurality at a time, in particular, two at a time, to be loaded at the same time.

Figure 5:
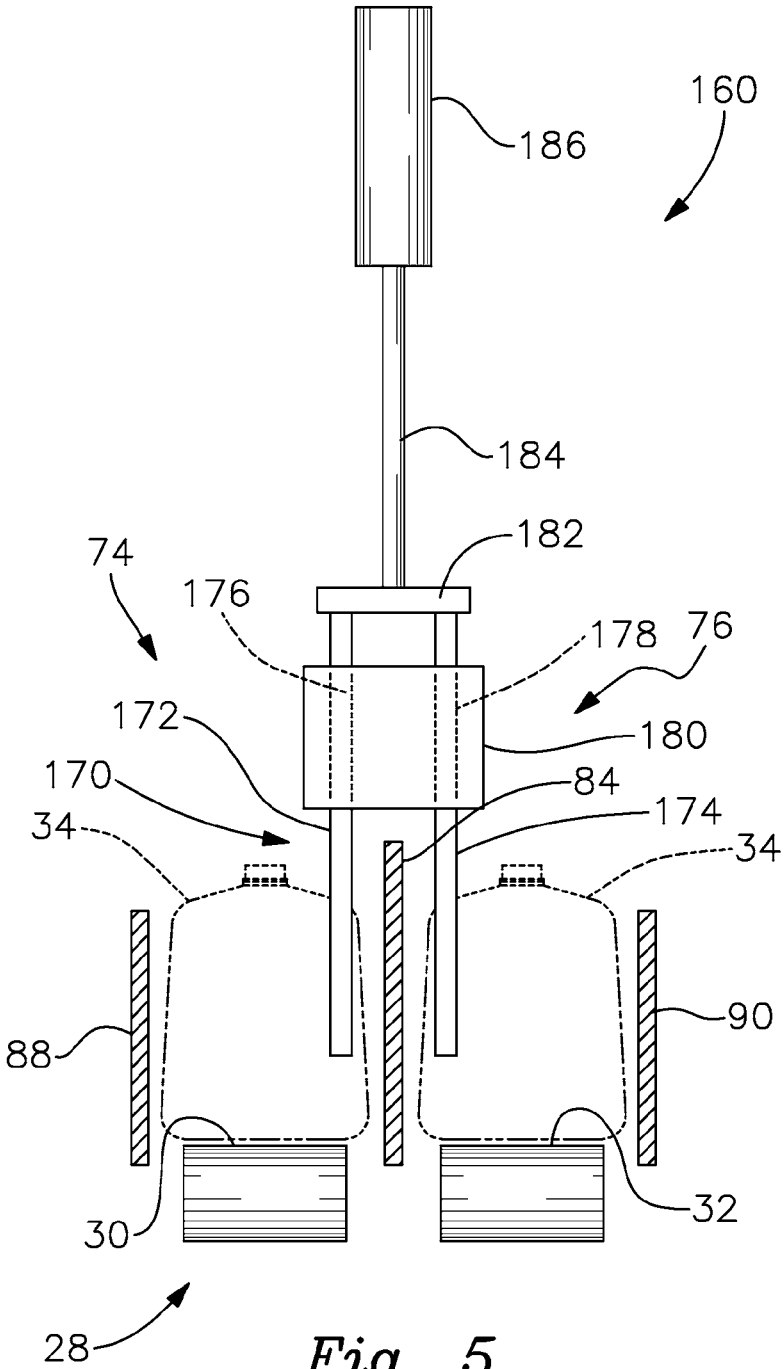
FIG. 5 is a cross-sectional view taken on line 5-5 of FIG. 1, looking generally upstream towards the article conveyor from the entry end of the loading station.
Figure 6:
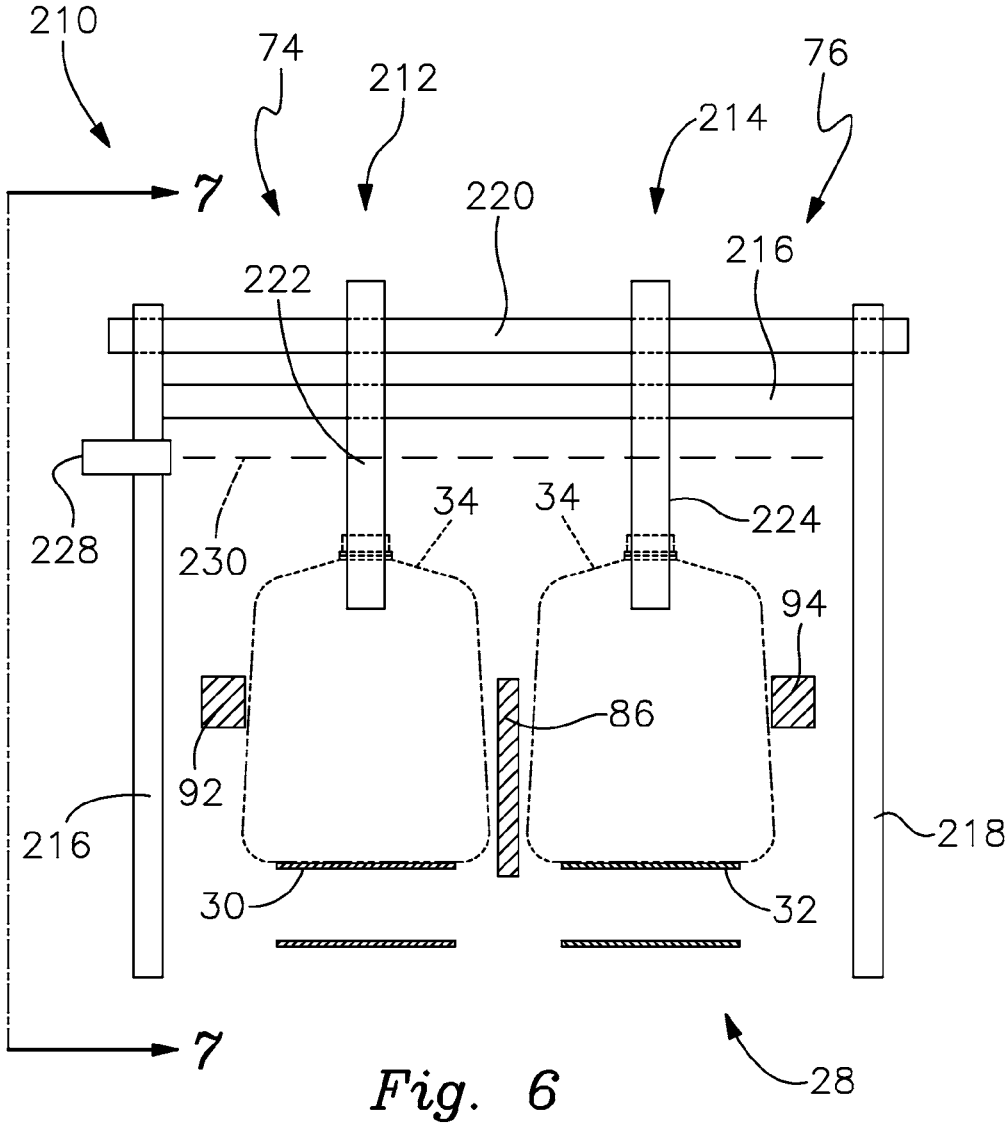
FIG. 6 is a view taken on line 6-6 of FIG. 1, looking upstream from a point on the article conveyor towards a pair of conveyor article sensors.

Referring briefly to FIGS. 5 and 6, the two modular conveyor belts 30 and 32 the article supply conveyor 28 are separated by a center divider having a relatively higher portion 84 shown in FIG. 5, and a relatively lower portion 86 farther upstream, shown in FIG. 6. Articles on the modular conveyor belts 30 and 32 are confined by side panels 88 and 90 shown in cross-section in FIG. 5, and by side guide rails 92 and 94 farther upstream as shown in FIG. 6. For clarity of illustration, the side panels 88 and 90 and guide rails 92 and 94 are omitted from FIG. 1.

The article supply conveyor 28 stops short of the loading station 22. Line pressure force is relied upon to move articles 34 into the upper portion 24 of the loading station 22.

Figure 2:
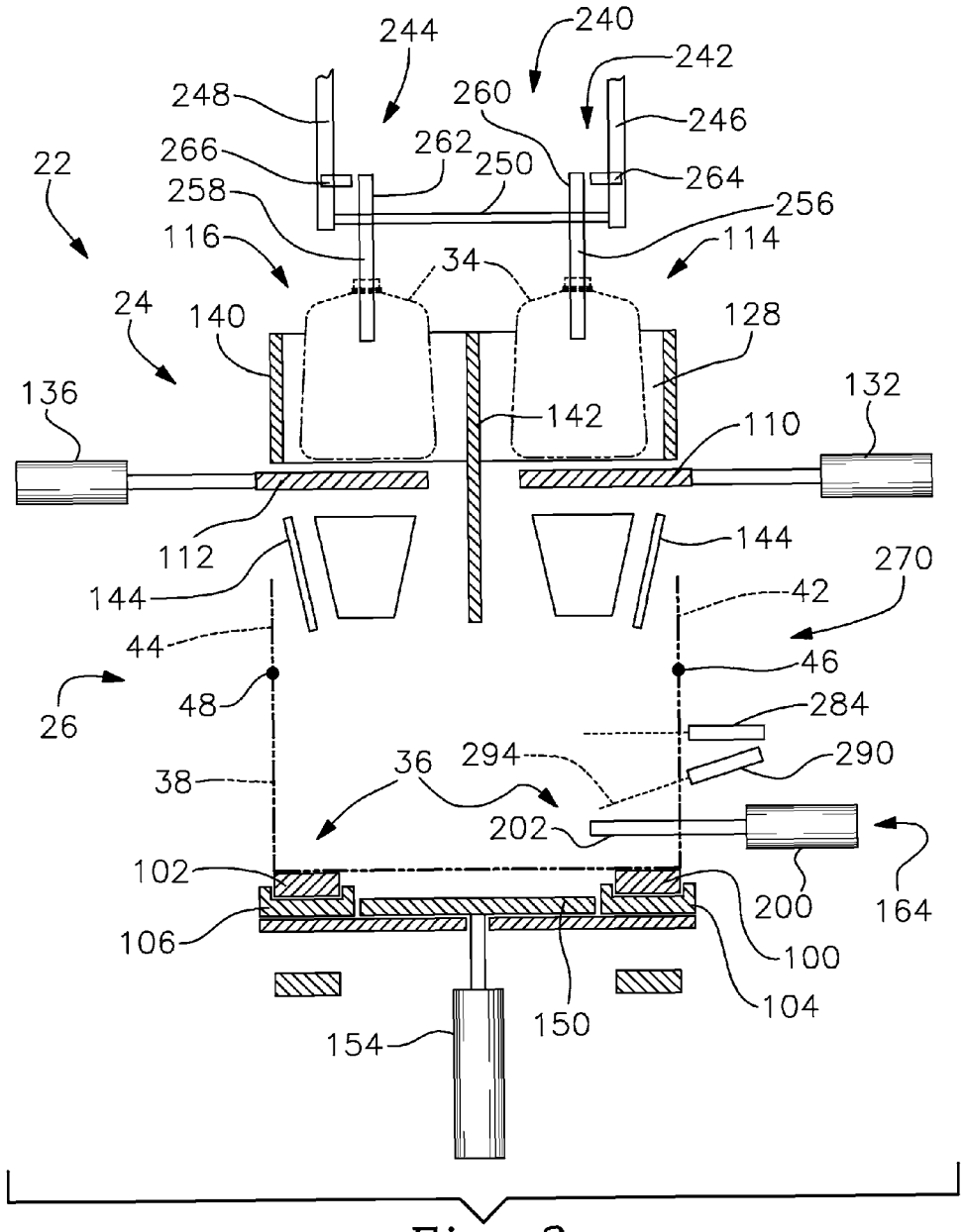
FIG. 2 is a cross-sectional view taken on line 2-2 of FIG. 1, looking downstream from a point within the loading station of FIG. 1.

In contrast, the case conveyor 36 extends all the way into the lower portion 26 of the loading station 22 approximately up to the downstream conveyor 50. With particular reference to FIG. 2, the case conveyor 50 includes a pair of flat top chains 100 and 102 or modular conveyor belts spaced apart approximately the width of a case 38 so that the two modular conveyor belts 100 and 102 together support and convey each of the cases 38. The modular conveyor belts 100 and 102 also are each a Rexnord style "880 series" flat top chain, and are supported in respective longitudinal bearing guides 104 and 106, made of a plastic material such as Acetal or UHMW which has a relatively low coefficient of friction.

Referring again to FIGS. 1-4, as its operative element, the upper portion 24 of the loading station 22 has a pair of pneumatically-actuated loading gates 110 and 112 onto which articles are delivered by the article supply conveyor 28 and on which the articles 34 are supported prior to being dropped into the cases 38. Articles 34 are moved onto the loading gates 110 and 112 by "line pressure force," described hereinbelow, in two lines 114 and 116 corresponding to the two lanes 74 and 76 of the article supply conveyor 28. The loading gates 110 and 112 each have an entry end 124 and an opposite end 126. The upper portion 24 of the loading station 22 is open at the entry end 124 of the loading gates 110 and 112, but is blocked at the opposite end 126 of the loading gates 110 and 112 by an end wall 128.

Figure 8:
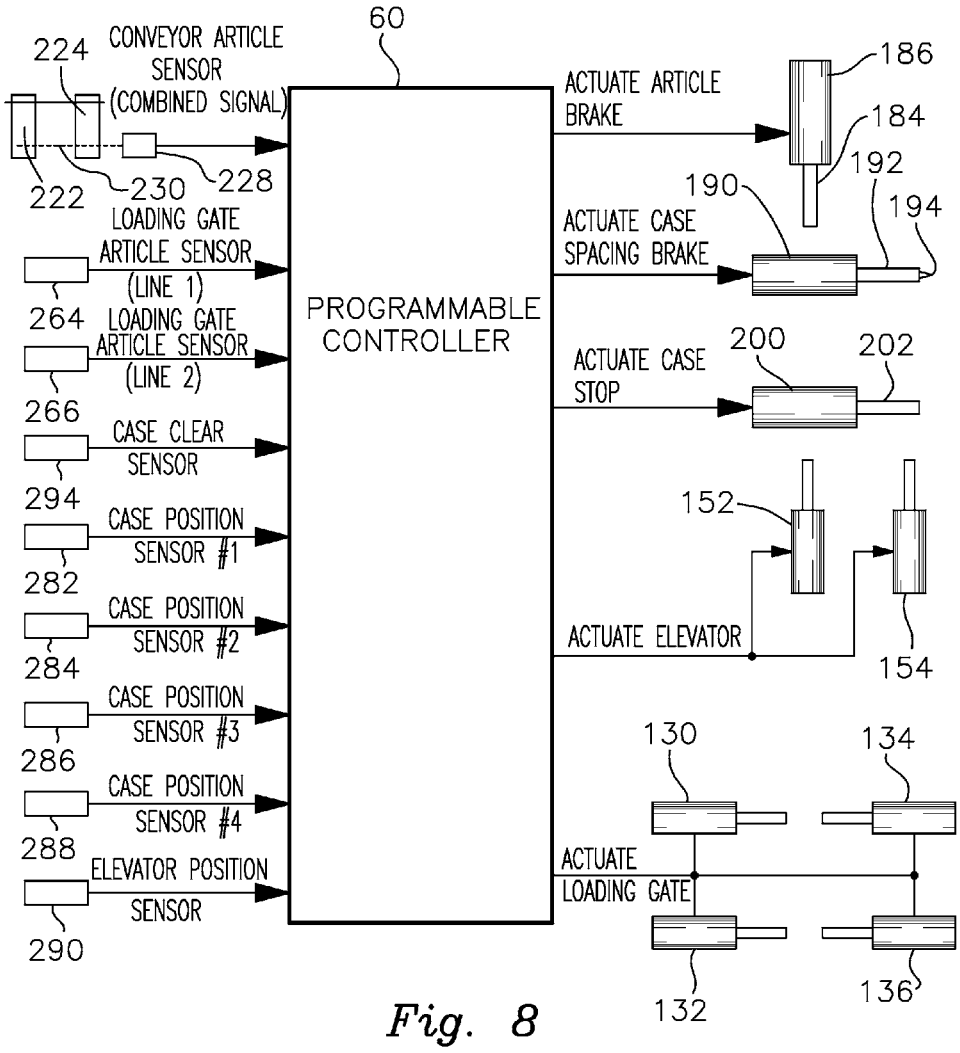
FIG. 8 is a highly representative electrical schematic diagram of a programmable controller included as part of the case loader, showing various inputs to and outputs from the programmable controller.

Each of the loading gates 110 and 112 is operated or moved by a pair of pneumatic cylinders, for a total of four loading gate actuator cylinders 130, 132, 134 and 136, all of which are schematically represented in FIG. 8. In the side elevational views of FIGS. 1, 3 and 4, loading gate actuator cylinders 130 and 132 are visible. In the cross-sectional view of FIG. 2, loading gate actuator cylinders 132 and 136 are visible.

In addition to the loading gates 110 and 112, the upper portion 24 of the loading station 22 includes a pair of side guide panels 138 and 140 for laterally confining articles 34 on the loading gates 110 and 112, as well as a center divider 142. The side guide panels 138 and 140 of the upper portion 24 of the loading station 22 are extensions of the side panels 88 and 90 at the downstream end of the article supply conveyor 28 shown in FIG. 5 but not shown in FIG. 1. Likewise, the center divider 142 is an extension of the portion 84 of the conveyor 28 center divider shown in FIG. 5. A plurality of grid fingers 144, in the illustrated embodiment twelve grid fingers 144, are provided for guiding the articles 34 as the articles 34 are dropped into the cases 38.

Figure 3:
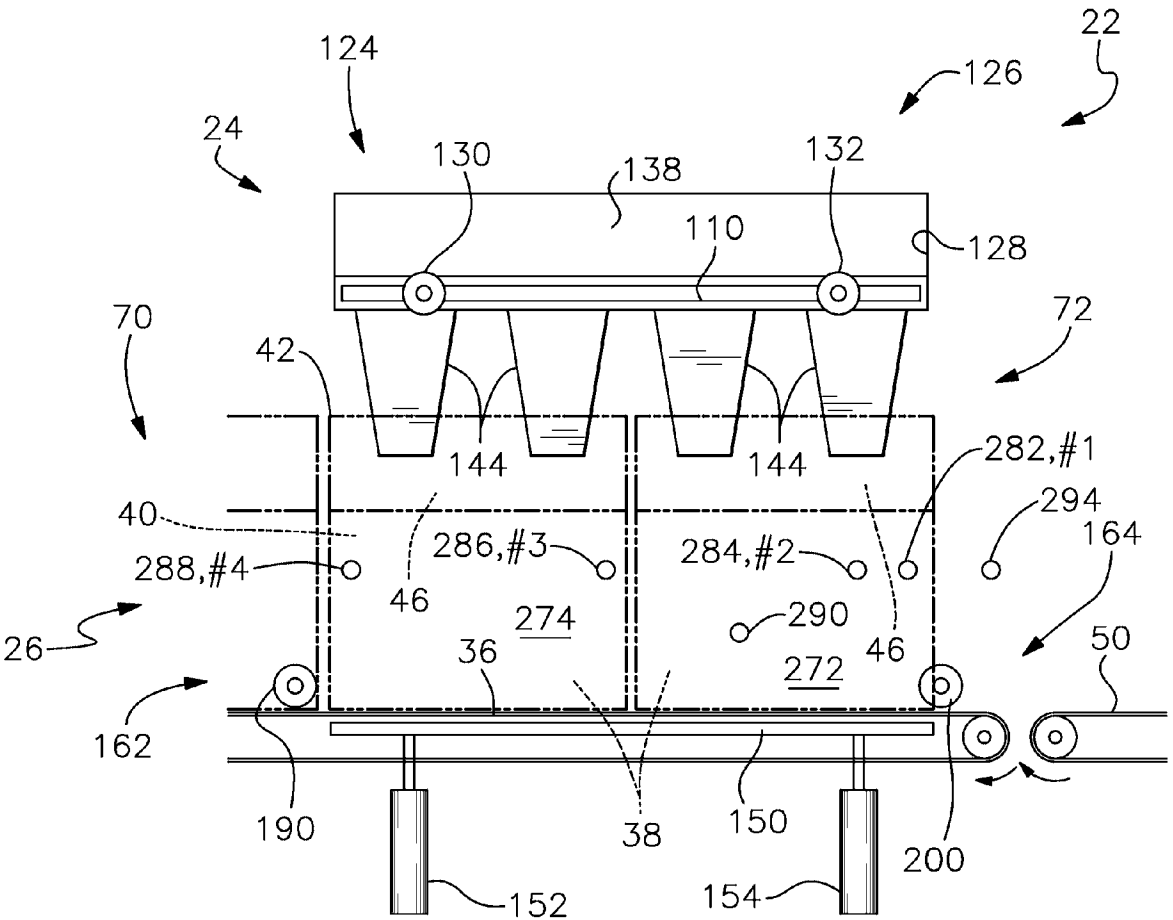
FIG. 3 is an enlarged side elevational view of a portion of the loading station of FIG. 1, showing the elevator and a pair of cases in a lowered position.

The lower portion 26 of the loading station 22 includes a loading platform 150 or elevator 150 over which cases 38 to be loaded are moved while the elevator 150 is in a lowered position as illustrated in FIGS. 1-3. With particular reference to FIG. 2, in its lowered position the elevator 150 is below and spaced from cases 38 supported on the tracks 100 and 102 of the case conveyor 36. Accordingly, when the elevator 150 is in its lowered position, cases 38 can be moved into position over the elevator 150 by the case conveyor 36, and as well can be carried off by the case conveyor 36 to exit via the downstream end 72 of the loading station 22 onto the downstream conveyor 50. Since the cases 38 have side flaps 42 and 44 only, the cases 38 are free to be conveyed under the upper portion 24 of the loading station 22, without interference by the grid fingers 144. Thus, and with reference to FIGS. 2 and 3, the main body 40 of each case 38 clears the grid fingers 144, while the side flaps 42 and 44 travel to the outside of the grid fingers 144. During operation, cases 38 are moved by the case conveyor 36 into position over the elevator 150 while the elevator 150 is in the lowered position of FIGS. 1-3. The elevator 150 subsequently is raised to a raised position illustrated in FIG. 4. The loading gates 110 and 112 subsequently are opened to drop articles 34 into the cases 38. The elevator 150 subsequently is lowered to the lowered position to allow loaded cases 38 to exit via the downstream end 72 of the loading station 22.

For raising and lowering the elevator 150, a pair of pneumatic cylinders 152 and 154 are provided, located underneath the elevator 150 or loading platform 150. In order to provide shock absorbing cushioning as articles 34 are dropped into cases 38, the pneumatic cylinders 152 and 154 each have a piston area selected and the pneumatic cylinders 152 and 154 are operated at a pressure such that the pneumatic cylinders 152 and 154 can fully raise and support the elevator 150 and empty cases 38 in the raised position of FIG. 4, but which allows the elevator 150 and loaded cases 38 to "sink" or move towards the lowered position of FIG. 3 under the dynamic force of dropped articles 34, even while the pneumatic cylinders 152 and 154 are under operating pressure. In other words, even though the programmable controller 60 of FIG. 8 is directing or commanding the pneumatic cylinders 152 and 154 to raise the elevator 150 to the fully-raised position of FIG. 4, the operating pressure is not sufficient to overcome the dynamic force of the dropped articles 34. As a result, shock absorbing cushioning is inherently provided as the articles 34 are dropped into the cases 38, resulting in less potential for damage.

As a particular example, the pneumatic cylinders 152 and 154 are each Parker FW2C111631X06.00 double acting cushioned pneumatic cylinders having a piston area of 4.90 square inches and a stroke of six inches, and designed to be operated at a pressure of 250 psig, to provide a force of 1225 pounds. In the disclosed embodiment, the pneumatic cylinders 152 and 154 are operated at a pressure of 18 psig, which provides a force sufficient to lift 88 pounds each. The elevator 150 and empty cases 38 weigh approximately thirty pounds, and the two pneumatic cylinders 152 and 154 accordingly together raise the elevator 150 and empty cases 38 to the fully raised position of FIG. 4. However, when four articles 34 in the form of one-gallon milk jugs are dropped into each of two cases 38 on the raised elevator 150 (approximately seventy dropped pounds total), the dynamic force developed overcomes the force exerted by the cylinders 152 and 154, and, in a cushioning action, the elevator 150 sinks towards the lowered position of FIG. 3, but without actually setting the loaded cases 38 down on the case conveyor 36. Thereafter, the FIG. 8 controller 60 commands or directs the pneumatic cylinders 152 and 154 to move the elevator 150 to the fully lowered position of FIG. 3, which sets the loaded cases 38 onto the case conveyor 36 to exit via the downstream end 72 of the loading station onto the downstream case conveyor 50.

As part of an orderly sequence of operation, an article brake, generally designated 160, is provided for holding articles from the article supply conveyor 28 short of the loading station 22. Among other things, this causes an accumulation of articles 34 on the article supply conveyor 28 producing line pressure force urging articles 34 towards the loading station 22 as the tracks 30 and 32 of the continuously-moving article conveyor 28 slide by underneath braked (stopped) articles.

Similarly, a case spacing brake 162 is provided for holding cases 38 from or conveyed by the case conveyor 36 short of the lower portion 26 of the loading station 22. The brake 162 is referred to as a "case spacing" brake because one of its functions is to achieve spacing between cases 38 on the case conveyor 36 and cases 38 within the loading station 22 in position over the elevator 150. In addition, a case stop 164 is provided, for holding cases 38 within the lower portion 26 of the loading station 22 in position over the elevator 150 and directly under the loading gates 120 and 122, particularly when the elevator 150 is in the lowered position as shown in FIG. 3.

Further details and operation of the article brake 160, the case spacing brake 162 and the case stop 164 are described in greater detail hereinbelow.

With reference to FIGS. 1 and 5, the article brake 160 more particularly takes the form of a vertically driven article stop 170 which descends to block the passage of articles (the position shown in FIGS. 1 and 5), and which is raised to allow the passage of articles 34. The vertically driven article stop 170 more particularly includes a pair of vertical rods 172 and 174, one for each of the two lanes 74 and 76. The vertical rods 172 and 174 pass through respective apertures 176 and 178 in a plastic bearing block 180, and are interconnected by a cross piece 182. The cross piece 182 is in turn driven by the rod 184 of a pneumatic cylinder 186. The pneumatic cylinder 186 is also represented in FIG. 8.

Figure 4:
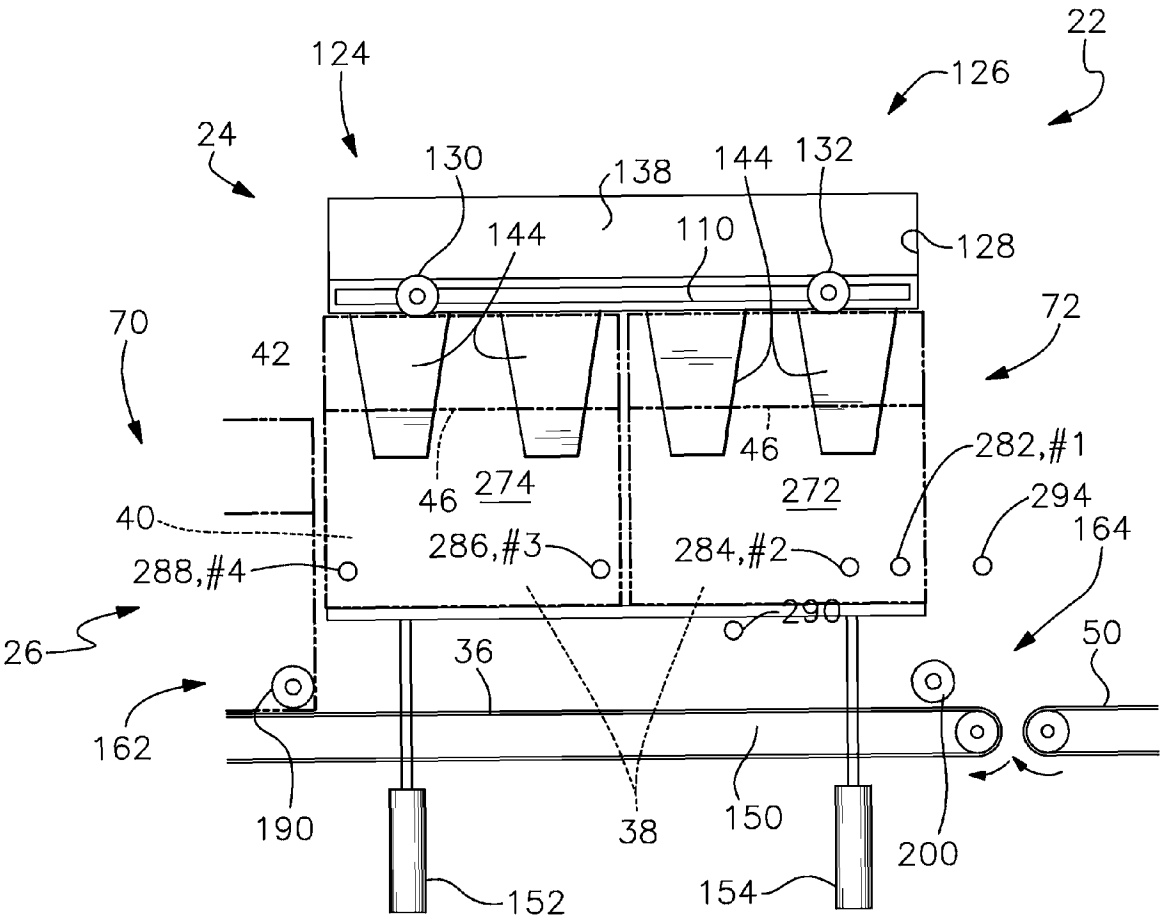
FIG. 4 is an enlarged side elevational view similar to that of FIG. 3, except with the elevator and cases in a raised position.

With reference to FIGS. 1, 3 and 4, the case spacing brake 162 takes the form of a pneumatic cylinder 190 (also represented in FIG. 8), having a cylinder rod 192. The cylinder rod 192 of the pneumatic cylinder 190 is arranged so as to either engage the side of a case 38 as illustrated in FIGS. 1, 3 and 4, (either by friction or aided by a projecting point 194 (FIG. 8) on the end of the rod 192), or by projecting out in front of into the path of the case 38 to serve as a barrier (not specifically shown). Which mode of holding cases 38 short of the loading station 22 occurs depends upon whether or not a case 38 happens to be positioned directly in front of the pneumatic cylinder 190 serving as the case spacing brake 162 when the pneumatic cylinder 190 is actuated.

The case stop 164 at the downstream end 72 of the loading station similarly takes the form of a pneumatic cylinder 200 (also represented in FIG. 8). The pneumatic cylinder 200 has a rod 202 which, as represented in FIG. 2, projects out into the path of oncoming cases to provide a positive barrier when actuated (in contrast to engaging the side of cases 38 as can occur during operation of the case spacing brake 162).

Although the representation of FIG. 1 implies steady and continuous supply of both articles 34 to be loaded and cases 38 into which the articles are to be loaded, as a practical matter, during actual operation, such is not always the case. The upstream supply of articles 34 (e.g. filled milk jugs) can be interrupted for a variety of reasons, depending upon other processes within the facility in which the case loader 20 is employed. Moreover, the supply of articles 34 may be interrupted in one of the lanes 74 or 76, but not the other. Likewise, for a variety of reasons, the upstream supply of empty cases 38 may be interrupted.

Accordingly, to achieve smooth and reliable operation the controller 60 of FIG. 8 directs the operation of the various actuated or controlled elements in an appropriate manner. The controlled elements include the article brake 160, case spacing brake 162 as well as the case stop 164, the pneumatic cylinders 152 and 154 which raise and lower the elevator 150, and the pneumatic cylinders 130, 132, 134 and 136 which open and close the loading gates 110 and 112. Inevitably, mis-positioning of articles 34 and cases 38 occurs, interrupting smooth loading operation and requiring manual intervention. However, embodiments of the invention minimize such occurrences.

As one particular aspect, the case loader 20 implements what is herein termed "line pressure control" to ensure that a sufficient number of articles 34 are backed up in each lane 74 and 76 of the article supply conveyor 28 to reliably push articles 34 onto the loading gates 110 and 112 of the loading station 22 when the article brake 160 is released.

So long as articles 34 are present on the article supply conveyor 28 in both lanes a predetermined distance "d" (FIG. 1) upstream of the loading station 22, there is sufficient line pressure force to reliably move articles 34 onto the loading gates 110 and 112 of the loading station 22. Although the terminology "predetermined distance" is employed herein, it will be appreciated that the predetermined distance "d" as a practical matter is a minimum distance, determined at least in part by experimentation; a "predetermined distance" may be conservatively established which is in fact greater than would be actually be required. By way of example, and not limitation, in one particular example, for a relatively slow line, the predetermined distance "d" is established as three feet nine inches, which is equivalent to the length along the article supply conveyor 28 occupied by eight one-gallon milk jugs (one more than the seven milk jugs which happen to be illustrated in FIG. 1). The "predetermined distance" varies based on line speed and bottle type.

Figure 7:
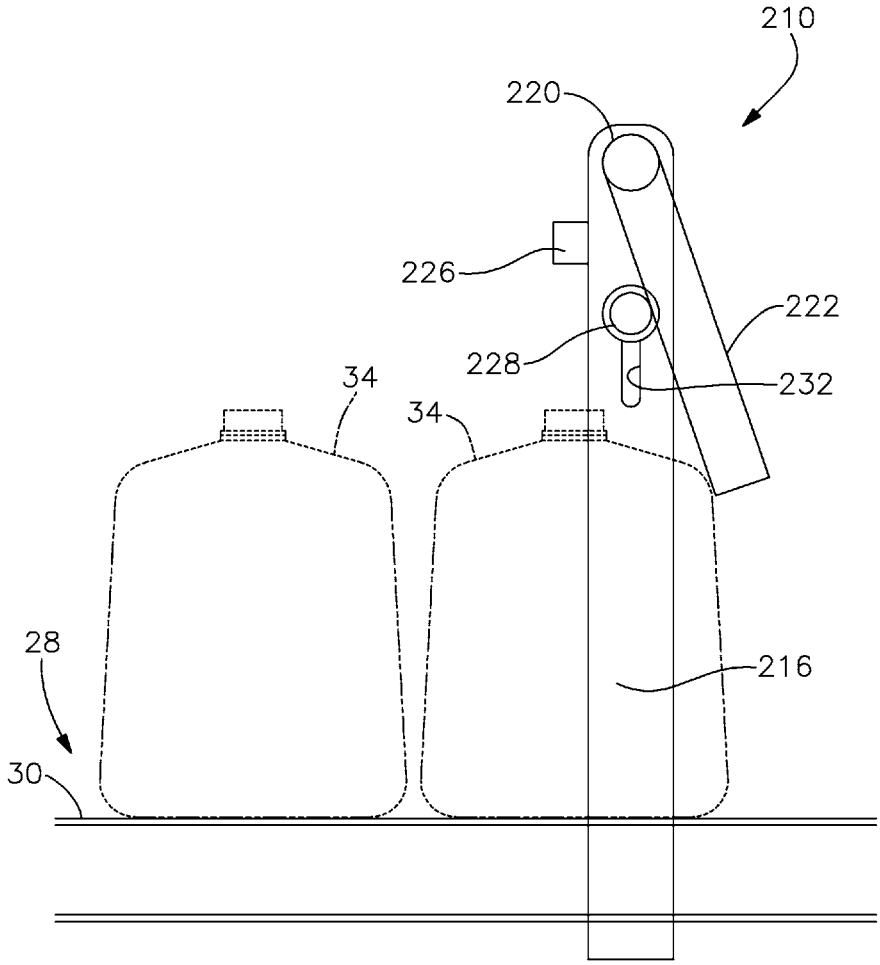
FIG. 7 is a side elevational view taken on line 7-7 of FIG. 6, illustrating the conveyor article sensors.

At least one conveyor article sensor, generally designated 210, is employed to sense the presence of articles 34 on the article supply conveyor 28 the predetermined distance "d" upstream of the loading station 22. With particular reference to FIGS. 6 and 7, in the illustrated embodiment, in which articles are carried in a plurality of lanes, in particular the two lanes 74 and 76 of the article supply conveyor 28, a corresponding plurality of conveyor article sensors are employed, in particular, conveyor article sensors 212 and 214.

The conveyor article sensor 210 includes two side supports 216 and 218, the lower structural connections for which are not shown. A pivot rod 220 extends between the side supports 216 and 218 near the upper ends thereof. A pair of swinging sensor arms 222 and 224 pivotally hang from the pivot rod 220. The two sensor arms 222 and 224 may be viewed as the individual conveyor article sensors 212 and 214 corresponding to the two lanes 74 and 76. When no articles 34 (e.g. milk jugs) are present, both sensor arms 222 and 224 hang vertically. However, when an article is present, as is best seen in FIG. 7, the sensor arms 222 and 224 pivot away from the vertical position. As each article 34 (milk jug) passes, the sensor arms 222 and 224 pivot further as required to allow unrestricted passage.

In order to prevent free swinging of the sensor arms 222 and 224 in a direction towards the upstream end of the article supply conveyor 28, a backstop bar 226 extends between the side supports 216 and 218 below the pivot rod 220.

The conveyor article sensor 210 additionally includes an optical sensor 228 defining a viewing or sensing line 230 extending from the side support 216 to the side support 218 directly under and parallel to the pivot rod 220. The optical sensor 228 is positioned so that both of the sensor arms 222 and 224 must be deflected for the optical sensor 228 to indicate the presence of articles. Thus, a logical "AND" function is provided in part by the mechanical arrangement, and the signal from the optical sensor 228 is a combined signal, responsive to both of the sensor arms 222 and 224 or conveyor article sensors. If an article 34 is present in one of the lanes 74 or 76 the predetermined distance "d" upstream of the loading station 22, but not in the other lane 74 or 76, then the sensor 228 does not provide a "true" signal. For adjustment purposes, the optical sensor 228 is mounted through a vertical slot 232.

A suitable sensor for the optical sensor 228 is an Allen-Bradley 42CA, 42CF, 42CM or similar photoelectric sensor.

To ensure that articles 34 are in position at the opposite end 126 (against the end wall 128) before the loading gates 110 and 112 are opened, a loading gate article sensor generally designated 240 is provided. Thus, at least one loading gate article sensor and, in the illustrated embodiment, a pair of loading gate article sensors 242 and 244, is provided to sense the presence of articles 34 at the opposite end 126 of the loading gates 110 and 112 against the end wall 128.

With particular reference to FIG. 2, the loading gate article sensor 240 includes a pair of side supports 246 and 248 extending downwardly from support structure above (not shown), and a pivot rod 250 extends between the side supports 246 and 248. A pair of levers 252 and 254 hang from the pivot rod 250, and are positioned so as to be deflected when articles 34 are present. The levers 252 and 254 have respective lower arms 256 and 258 which are actually contacted by the articles 34 when present and are thereby moved in a downstream direction, and respective upper arms 260 and 262 which are pivoted in an upstream direction when articles are present. To sense the position of the upper arms 260 and 262, and thus whether articles 34 are present in the two lines 114 and 116 on the loading gates 110 and 112, respective inductive proximity sensors 264 and 266 are employed. When articles 34 are not present, then the levers 252 and 254 hang vertically, and the inductive proximity sensors 264 and 266 sense the proximity of the upper arms 260 and 262. When articles 34 are in position on the loading gates 110 and 112, the inductive proximity sensors 264 and 266 sense that the upper arms 260 and 262 have moved away, which is the signal condition indicating article presence. Suitable sensors for the inductive proximity sensors 264 and 266 are Allen-Bradley 871™ or similar inductive proximity sensors.

Significantly, use of the loading article sensors 242 and 244 in combination with line pressure control effected by use of the conveyor article sensors 212 and 214 for each of the lanes 74 and 76 provides a high degree of reliability in ensuring that articles are properly moved onto the loading gates 110 and 112 and in proper position before the loading gates 110 and 112 are opened to drop articles 34 into cases 38 below.

Another aspect of the case loader 20 is that sensors are employed as described hereinbelow in detail and the case loader 20 is operated in a manner which ensures that cases 38 are in position before the elevator 150 is raised and before the loading gates 110 and 112 are opened. In addition, sensors are provided (again, as described in detail hereinbelow) and the case loader 20 is operated in a manner such that loaded cases are sufficiently on their way out of the loading station 22 onto the downstream conveyor 50 before the case spacing brake 162 is released, allowing empty cases 38 to enter the lower portion 26 of the loading station 22. In addition, sensors are provided (again, as described hereinbelow) and the case loader 20 is operated in a manner such that cases 38 are at least nearly in position before the case spacing brake 162 is reapplied. Moreover, in the illustrated embodiment a plurality of cases, in particular two cases 38, are loaded at the same time.

More particularly, an array, generally designated 270, of case sensors is employed to ensure that previously-loaded cases 38 are sufficiently on their way exiting via the downstream end 72 of the loading station 22 before the case spacing brake 162 is released to allow the plurality of cases to move into position over the elevator 150 while the elevator 150 is in the lowered position, employed to determine that the plurality of cases 38 are at least nearly in position over the elevator 150 before the case spacing brake 162 is applied to hold subsequent cases short of the loading station 22, employed to ensure that the plurality of cases 38 are in position over the elevator 150 before the elevator is raised and before the loading gates 110 and 112 are opened to drop articles 34 into the plurality of cases 38, and employed to ensure that the trailing end of the last of the plurality of case 38 has exited the loading station 22 past the case stop 164 before the case stop 164 is engaged to hold the subsequent cases in position over the elevator 150.

Although cases are generally designated 38, embodiments of the invention load a plurality of cases 38 at the same time, in the illustrated embodiment two cases. In the following description of the array 270 of case sensors, reference is made to two cases designated 272 and 274 (FIGS. 3 and 4) being loaded at the same time. Case 272 is the relatively downstream or first case, and case 274 is the relatively upstream or second case.

With particular reference to FIGS. 1, 3 and 4, four case position sensors 282, 284, 286 and 288 are employed, respectively designated case position sensors #1, #2, #3 and #4. For clarity of illustration, supports for the case position sensors 282, 284, 286 and 288 are not shown. The case position sensors 282, 284, 286 and 288 are located just off to the side as indicated by the positioning of the case position sensor 286 (sensor #3) in FIG. 3. The case position sensors 282, 284, 286 and 288 (sensors #1, #2, #3 and #4) are positioned such that cases 272 and 274 are sensed, if present, whether in the lower position (FIG. 3) or upper position (FIG. 4). The case position sensors 282, 284, 286 and 288 are optical sensors, and may be Allen-Bradley 42SRP or similar photoelectric sensors.

Additionally, an elevator position sensor 290 is provided. The elevator position sensor 290 is employed to sense when the elevator 150 is raised, to ensure that the loading gates 110 and 112 are not opened unless the elevator 150 is in its raised position. As shown in FIG. 2, the line of sight 292 of the elevator position sensor 290 is angled downwardly so as to view an empty space underneath the elevator 150 when the elevator 150 is raised, as is also apparent by contrasting FIG. 4 (elevator 150 raised) with FIG. 3 (elevator 150 lowered).

The exemplary cases 272 and 274 are each twelve inches long. Case position sensor 282 (#1) is positioned so as to be very near the leading end of the first case 272 when the case 272 is against the case stop 164, such as one inch from the case stop 164. Case position sensor 284 (#2) is located several inches upstream, such as six inches upstream. Case position sensors 286 and 288 (#3 and #4) are respectively positioned very near the leading and trailing ends of the second case 274 when the second case 274 is in proper position. For twelve-inch cases 272 and 274, sensors #3 and #4 are 11½ inches apart. Moreover, the case position sensor 286 (#3) is located so as to sense a gap (the absence of a case) in the event two cases 272 and 274 on the elevator 150 are too far apart, in which case operator intervention is required to correct the mis-positioning to allow operation to continue.

A final sensor illustrated in FIGS. 1, 3 and 4 is a case clear sensor 294, likewise an optical sensor employed to ensure that loaded cases 38 (e.g. cases 272 and 274) have completely exited the loading station 22 before the case stop 164 is reengaged.

The overall operation of the case loader 20 is controlled by the programmable controller 60, represented in FIG. 8 by various sensor inputs and control outputs. A suitable programmable controller is an Allen-Bradley "MicroLogix 1000" programmable logic controller. It will be appreciated that conventional interfacing devices such as optical isolators and drivers are omitted from FIG. 8. Likewise, it will be appreciated that the various pneumatic cylinders are operated from a compressed air supply, controlled via conventional solenoid valves which likewise are not specifically shown.

Figure 9:
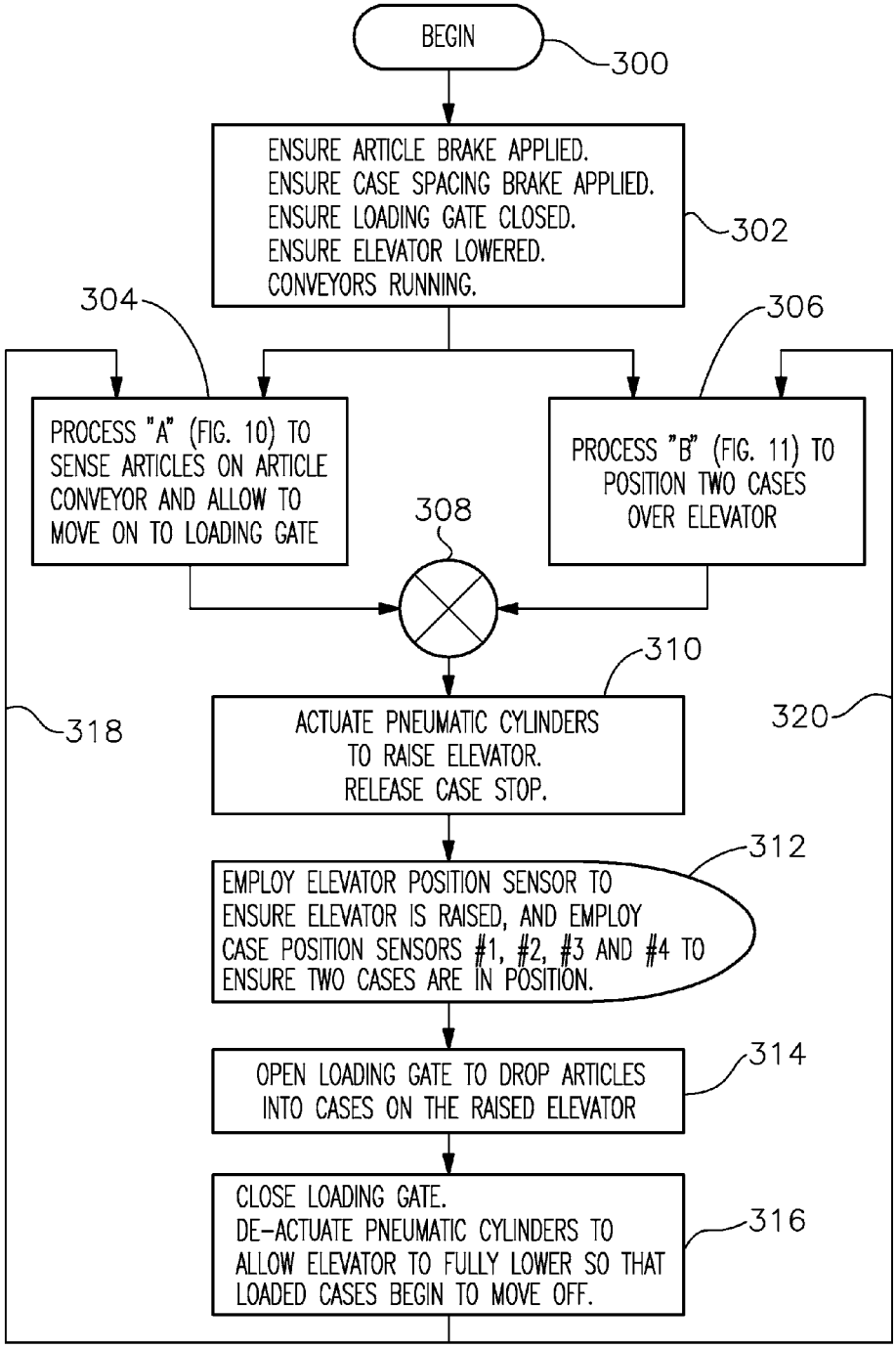
FIG. 9 is a high level flowchart representing programming within the programmable controller of FIG. 8.
Figure 10:
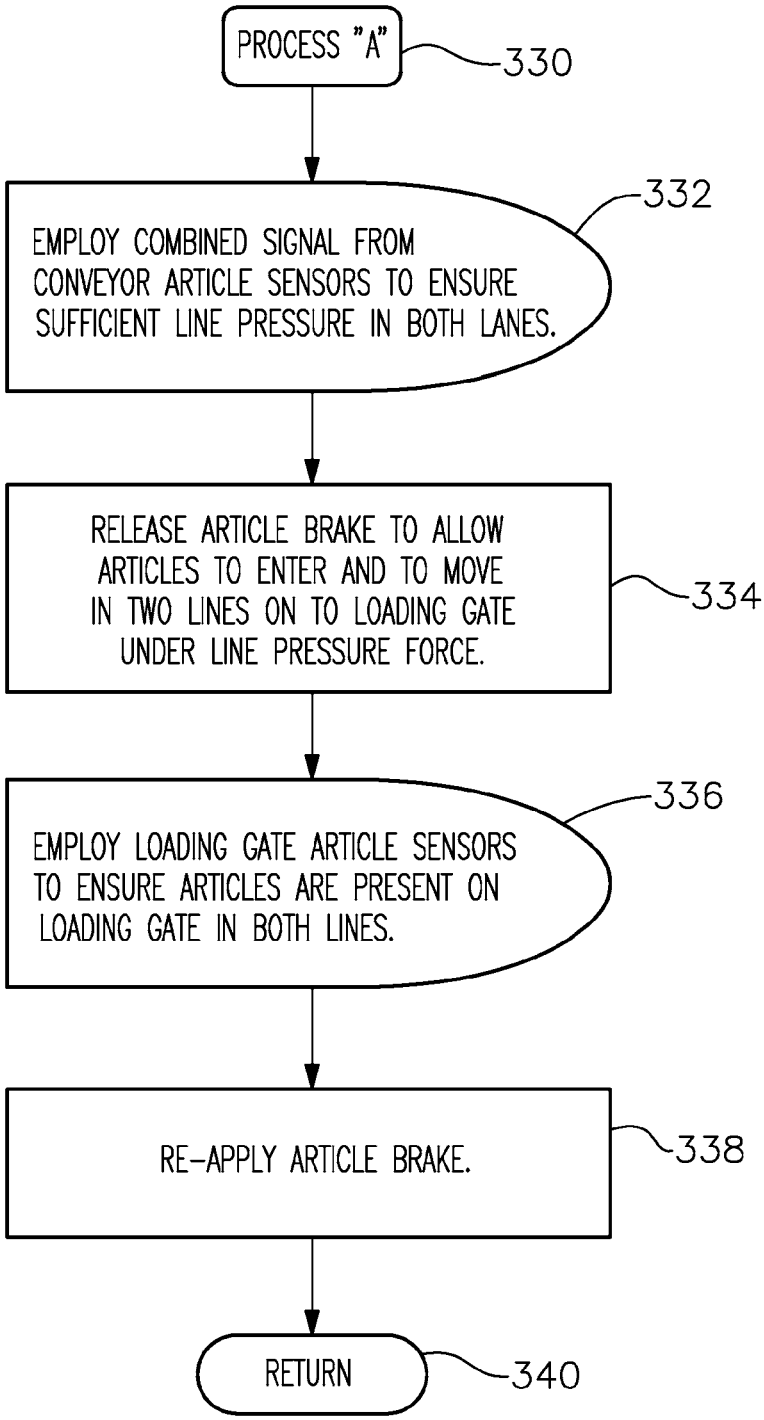
FIG. 10 is a flowchart representing a "Process 'A'" routine programmed within the programmable controller of FIG. 8, and called by the FIG. 9 routine.
Figure 11:
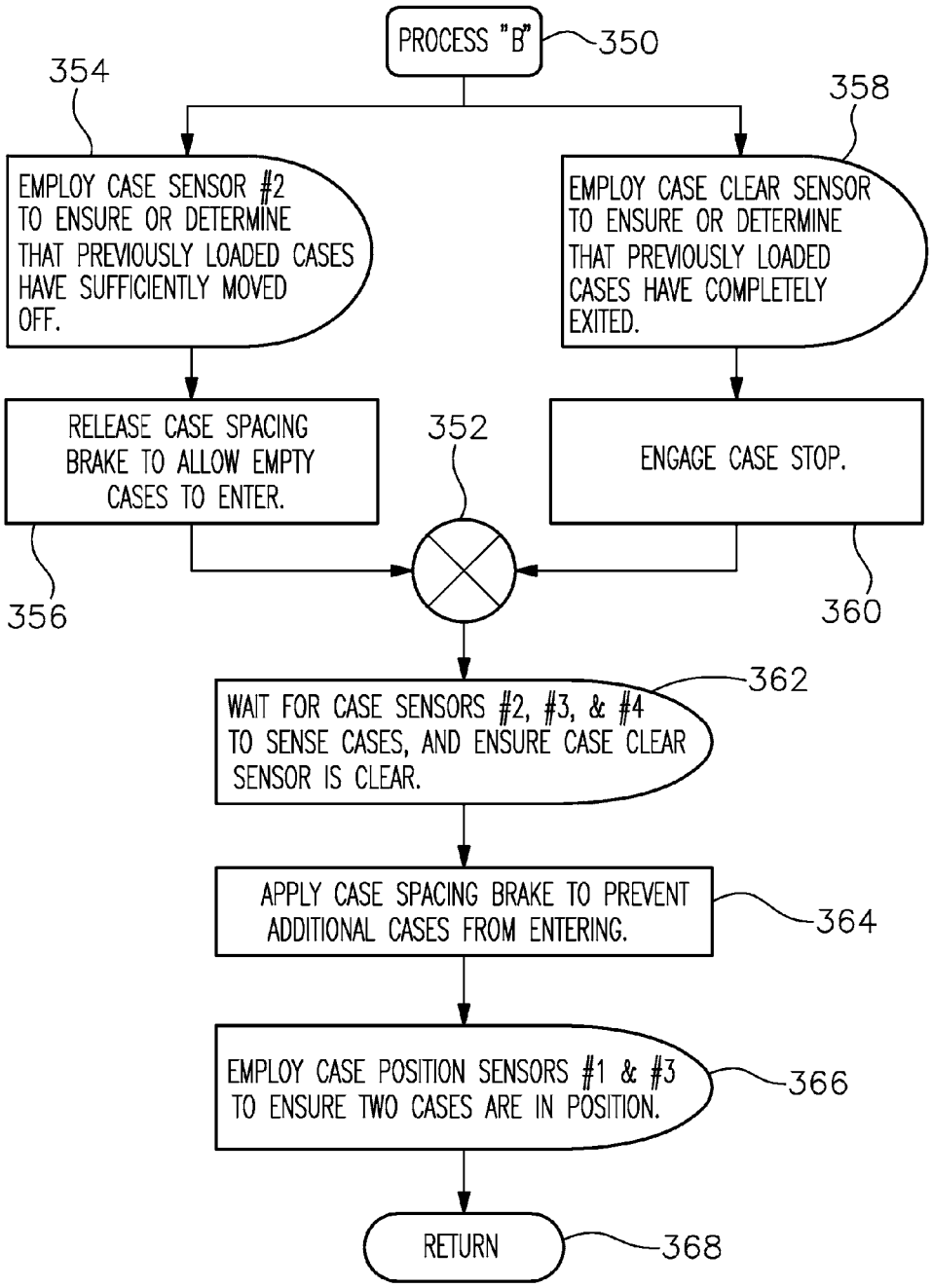
FIG. 11 is a flowchart representing a "Process 'B'" routine also programmed within the programmable controller of FIG. 8 and called by the FIG. 9 routine.

Programming within the FIG. 8 programmable controller 60 to effect overall operation is represented in the program flowcharts of FIGS. 9, 10 and 11. The FIG. 9 flowchart represents the overall operation, which loops continuously during operation of the case loader 20 to effect a cyclical sequence of operations. In the event of a malfunction, such as articles 34 or cases 38 being mis-positioned as inevitably happens from time to time, operation pauses while an operator manually corrects the condition, and operation resumes with minimal disruption or loss of product.

With particular reference to FIG. 9, the program enters at 300. In box 302, an initialization sequence occurs. The controller 60 ensures that the article brake 160 is applied, ensures that the case spacing brake 162 is applied, ensures that the loading gates 110 and 112 are closed, ensures that the elevator 150 is lowered, and ensures that the conveyors 28, 36 and 50 are running.

Beginning the main loop of the program, execution proceeds to two concurrent processes, represented by boxes 304 and 306, both of which must be completed before operation continues from "AND" junction 308. Box 304 represents a process "A" represented by the flowchart of FIG. 10, to sense the presence of articles 34 on the article supply conveyor 28 and to allow the articles 34 to move onto the loading gates 110 and 112. More particularly, as part of the cyclical sequence of operations, articles 34 on the article supply conveyor 28 are held short of the loading station 22 by the article brake 160. Sensors are employed to ensure that articles 34 are present in both lanes 74 and 76 of the article supply conveyor 28 the predetermined distance "d" upstream of the loading station to develop sufficient line pressure force before releasing the article brake 160 thereby releasing the articles 34 to move onto the loading gates 110 and 112 urged by line pressure force. Box 306 represents a process "B" represented in the flowchart of FIG. 11, which positions two cases 38 over the elevator 150. More particularly, a part of the cyclical sequence of operations, sensor #2 is employed to ensure that previously-loaded cases are sufficiently on their way exiting via the downstream end 72 of the loading station 22 before releasing the case spacing brake 162 to allow a plurality of cases (e.g. the two cases 272 and 274) to move into position over the elevator 150 while the elevator is in its lowered position. The case clear sensor 294 is employed to ensure that the last of the plurality of cases has exited past the case stop 164 before engaging the case stop 164 to hold subsequent cases in position over the elevator 150.

When both those conditions are satisfied, then execution proceeds from "AND" junction 308 to box 310 where the pneumatic cylinders 152 and 154 are actuated to raise the elevator 150. At the same time, the case stop 164 is released, since cases lifted by the elevator 150 are not subject to being conveyed by the case conveyor 36 while raised off the conveyor 36, and the case stop 164 is not needed.

Next, in box 312, represented as a delay process, the elevator position sensor 290 is employed to ensure the elevator 150 is raised. In addition, all four case position sensors 282, 284, 286 and 288 (sensors #1, #2, #3 and #4) are employed to ensure that both cases 272 and 274 are in position on the elevator 150 as the elevator 150 is raised to the position of FIG. 4.

In box 314, the programmable controller 60 commands the loading gate actuator cylinders 130, 132, 134 and 136 to open the loading gates 110 and 112, to drop articles 34 into the cases 38 on the raised elevator 150. As described hereinabove, the dynamic force as articles 34 are dropped into the cases 38 causes the elevator 150 to immediately lower, even though the controller 60 is commanding the elevator 150 to be in the raised position, because the pneumatic cylinders 152 and 154 are operated at a reduced pressure as described hereinabove. Thus, shock absorbing cushioning is provided, while the cases 38 are still held above the case conveyor 36.

Finally, in box 316, the loading gates 110 and 112 are closed, and the pneumatic cylinders 152 and 154 are deactuated to allow the elevator 150 to fully lower. Since the case stop 164 has previously been released, loaded cases 38 immediately begin to move off upon contact with the case conveyor 36.

As indicated by lines 318 and 320, execution then loops back to process "A" box 304 and process "B" box 306, and the cycle continues.

With reference to FIG. 10, process "A" enters at box 330. In box 332, represented as a delay process, the combined signal from the optical sensor 228 and the individual conveyor article sensors 212 and 214 is employed to ensure that articles 34 are present the predetermined distance "d" upstream from the loading station 22, ensuring sufficient line pressure force in both lanes 74 and 76. If there has been an interruption in the upstream supply flow of articles 34, execution simply waits until articles are present.

Next, in box 334, the article brake 160 is released to allow articles 34 to enter the upper portion 24 of the loading station 22, and to move in the two lines 114 and 116 onto the loading gates 110 and 112 under line pressure force.

Next, in box 336, again represented as a delay process, the loading gate article sensors 242 and 244 are employed to ensure that articles are present on the loading gates 110 and 112 in both lines 114 and 116.

At that point, in box 338, the article brake 160 is reapplied, and execution returns at 340 to the main routine of FIG. 1, entering the "AND" junction 308 from the left side.

With reference to the flowchart of FIG. 11, process "B" enters at 350, and then splits to two concurrent processes, both of which must be satisfied in "AND" junction 352 before execution continues.

In the left hand branch, box 354 the controller 60 employs case position sensor 284 (#2) to ensure or determine that previously-loaded cases have sufficiently moved off. Then, in box 356, the case spacing brake 162 is released to allow empty cases 38 to enter (which may or may not enter at that time, depending upon whether empty cases are present on the case conveyor 36).

The right hand branch begins with box 358, represented as a delay process, where the case clear sensor 294 is employed to ensure or determine that previously-loaded cases have completely exited the loading station 22 then, in box 360, the case stop 164 is engaged.

When both branches are satisfied, execution proceeds from "AND" junction 352 to box 362, represented as another delay process, to wait for case position sensors 284, 286 and 288 (sensors #2, #3 and #4) to sense incoming cases, and also to ensure that the case clear sensor 294 is still clear.

At that point, in box 364, the case spacing brake 162 is applied to prevent additional cases from entering the loading station 222. If cases are continuously present on the case conveyor 36, then likely the case spacing brake 162 will engage the side of a case depicted in FIG. 1. Otherwise, the case spacing brake 162 will project out in the path of oncoming cases, to block the next case to arrive.

In box 366, again represented as a delay process, case position sensors 282 and 286 (sensors #1 and #3) are employed to ensure that two cases are in position. The FIG. 11 process then exits at 368, to enter the "AND" junction 308 of the FIG. 9 flowchart from the right side.

While specific embodiments of the invention have been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. A method of forming arrays of articles and dropping the articles into upwardly open cases at a loading station of the type having an upstream end and a downstream end, and including a loading gate on which articles are supported prior to being dropped, the loading gate having an entry end and an opposite end, and an elevator having lowered and raised positions for positioning cases below the loading gate, said method comprising:

employing an article supply conveyor including a moving belt on which articles are carried to deliver articles to the loading station;

conveying cases to the upstream end of the loading station;

holding articles from the article supply conveyor short of the loading station, causing an accumulation of articles on the article supply conveyor and producing line pressure force urging articles towards the loading station; and effecting a cyclical sequence of operations by employing a conveyor article sensor positioned so as to sense the presence of an article on the article supply conveyor a predetermined distance upstream of the loading station away from the loading gate to ensure that articles are present on the article supply conveyor a predetermined distance upstream to develop sufficient line pressure force before releasing articles to move onto the loading gate via the loading gate entry end urged by line pressure force, allowing at least one case to move into position over the elevator while the elevator is in the lowered position, subsequently raising the elevator to the raised position, and subsequently opening the loading gate to drop articles into the at least one case, and subsequently lowering the elevator to the lowered position and allowing a loaded case to exit via the downstream end of the loading station.

2. The method of claim 1, which further comprises employing at least one pneumatic cylinder located underneath the elevator to raise and lower the elevator and to provide shock absorbing cushioning as articles are dropped into cases, the at least one pneumatic cylinder having a piston area selected and the pneumatic cylinder being operated at a pressure such that the at least one pneumatic cylinder can raise and support the elevator and empty cases at the raised position, but allows the elevator to move towards the lowered position under the dynamic force of dropped articles even under operating pressure.

3. The method of claim 1, wherein said step of effecting a cyclical sequence of operations includes sensing that articles are present at the opposite end of said loading gate and presumably in position on said loading gate before opening the loading gate to drop articles into the at least one case.

4. A method of forming arrays of articles and dropping the articles into upwardly open cases at a loading station of the type having an upstream end and a downstream end, and including a loading gate on which articles are supported prior to being dropped, the loading gate having an entry end and an opposite end, and an elevator having lowered and raised positions for positioning cases below the loading gate, said method comprising:

employing an article supply conveyor including a moving belt on which articles are carried to deliver articles to the loading station in a plurality of lanes;

conveying cases to the upstream end of the loading station;

holding articles from the article supply conveyor short of the loading station, causing an accumulation of articles on the article supply conveyor and producing line pressure force urging articles towards the loading station; and effecting a cyclical sequence of operations by ensuring that articles are present on the article supply conveyor a predetermined distance upstream in all of the plurality of lanes to develop sufficient line pressure force before releasing articles to move onto the loading gate in a corresponding plurality of lines via the loading gate entry end urged by line pressure force, allowing at least one case to move into position over the elevator while the elevator is in the lowered position, subsequently raising the elevator to the raised position, and sensing that articles are present at the opposite end of said loading gate and presumably in position on said loading gate before subsequently opening the loading gate to drop articles into the at least one case, and subsequently lowering the elevator to the lowered position and allowing a loaded case to exit via the downstream end of the loading station.

5. The method of claim 4, wherein said step of effecting a cyclical sequence of operations includes sensing that articles are present at the opposite end of said loading gate in all of the plurality of lines and presumably in position on said loading gate before opening the loading gate to drop articles into the at least one case.

6. A case loader for forming arrays of articles and dropping the articles into upwardly open cases, said case loader comprising:

a loading station having an upstream end and a downstream end, said loading station including a loading gate on which articles are supported prior to being dropped, said loading gate having an entry end and an opposite end, and an elevator having lowered and raised positions for positioning cases below said loading gate;

an article supply conveyor including a moving belt on which articles are carried and delivered to said loading station to be moved on to said loading gate;

an article brake for holding articles from said article supply conveyor short of said loading station, causing an accumulation of articles on said article supply conveyor and producing line pressure force urging articles towards said loading station;

at least one conveyor article sensor positioned so as to sense the presence of an article on said article supply conveyor a predetermined distance upstream of said loading station away from said loading gate, said conveyor article sensor employed to ensure that articles are present on said article supply conveyor the predetermined distance upstream to develop sufficient line pressure force before releasing said article brake to allow articles to move onto said loading gate via said loading gate entry end urged by line pressure force; and a case conveyor carrying and at least delivering cases to the upstream end of said loading station to be moved into position over said elevator while said elevator is in the lowered position;

during operation at least one case being allowed to move into position over said elevator while said elevator is in the lowered position, said elevator subsequently being raised to the raised position before said loading gate is opened to drop articles into the at least one case, and said elevator subsequently being lowered to the lowered position to allow a loaded case to exit via the downstream end of said loading station.

7. The case loader of claim 6, which further comprises at least one loading gate article sensor employed to sense the presence of articles at the opposite end of said loading gate to ensure that articles are in position on said loading gate before opening said loading gate to drop articles into the at least one case.

8. The case loader of claim 1, which further comprises at least one pneumatic cylinder located underneath said elevator for raising and lowering said elevator and for serving to provide shock absorbing cushioning as articles are dropped into cases, said at least one pneumatic cylinder having a piston area selected and said pneumatic cylinder being operated at a pressure such that said at least one pneumatic cylinder can raise and support said elevator and empty cases at the raised position, but allows said elevator to move towards the lowered position under the dynamic force of dropped articles even under operating pressure.

9. The case loader of claim 6, wherein said article brake comprises a vertically driven article stop which descends to block the passage of articles.

10. A case loader for forming arrays of articles and dropping the articles into a plurality of upwardly open cases at the same time, said case loader comprising:

a loading station having an upstream end and a downstream end, said loading station including a loading gate on which articles are supported prior to being dropped, said loading gate having an entry end and an opposite end, and an elevator having lowered and raised positions for positioning cases below said loading gate, said elevator being sized to support the plurality of cases;

an article supply conveyor including a moving belt on which articles are carried and delivered to said loading station to be moved on to said loading gate;

an article brake for holding articles from said article supply conveyor short of said loading station, causing an accumulation of articles on said article supply conveyor and producing line pressure force urging articles towards said loading station;

at least one conveyor article sensor employed to sense the presence of articles on said article supply conveyor a predetermined distance upstream of said loading station to ensure that articles are present on said article supply conveyor the predetermined distance upstream to develop sufficient line pressure force before releasing said article brake to allow articles to move onto said loading gate via said loading gate entry end urged by line pressure force;

a case conveyor carrying and at least delivering cases to the upstream end of said loading station to be moved into position over said elevator while said elevator is in the lowered position;

a case spacing brake for holding cases from said case conveyor short of said loading station;

a case stop for holding cases within said loading station in position over said elevator; and an array of case sensors employed to ensure that previously-loaded cases are sufficiently on their way exiting via the downstream end of said loading station before said case spacing brake is released to allow the plurality of cases to move into position over said elevator while said elevator is in the lowered position, employed to determine that the plurality of cases are at least nearly in position over said elevator before said case spacing brake is applied to hold subsequent cases short of said loading station, employed to ensure that the plurality of cases are in position over said elevator before said elevator is raised and before said loading gate is opened to drop articles into the plurality of cases, and employed to ensure the trailing end of the last of the plurality of cases has exited said loading station past said case stop before said case stop is engaged to hold the subsequent cases in position over said elevator;

during operation said case spacing brake being released to allow the plurality of cases to move into position over said elevator and to be held by said case stop while said elevator is in the lowered position, said elevator subsequently being raised to the raised position before said loading gate is opened to drop articles into the plurality of cases, said case stop subsequently being released, said elevator subsequently being lowered to the lowered position, and the plurality of cases being allowed to exit via the downstream end of said loading station.

11. The case loader of claim 10, which further comprises an elevator sensor employed to ensure said elevator is in the raised position before said loading gate is opened.

12. A case loader for forming arrays of articles and dropping the articles into upwardly open cases, said case loader comprising:

a loading station having an upstream end and a downstream end, said loading station including a loading gate on which articles are supported prior to being dropped, said loading gate having an entry end and an opposite end, and an elevator having lowered and raised positions for positioning cases below said loading gate;

an article supply conveyor including a moving belt on which articles are carried in a plurality of lanes and delivered to said loading station to be moved on to said loading gate;

an article brake for holding articles from said article supply conveyor short of said loading station, causing an accumulation of articles on said article supply conveyor and producing line pressure force urging articles towards said loading station;

a plurality of conveyor article sensors corresponding to the plurality of lanes positioned so as to individually sense the presence of an article on said article supply conveyor in each of the plurality of lanes a predetermined distance upstream of said loading station away from said loading gate, said conveyor article sensors employed to ensure that articles are present on said article supply conveyor the predetermined distance upstream in all of the plurality of lanes to develop sufficient line pressure force before releasing said article brake to allow articles to move onto said loading gate in a plurality of lines corresponding to the plurality of lanes via said loading gate entry end urged by line pressure force; and a case conveyor carrying and at least delivering cases to the upstream end of said loading station to be moved into position over said elevator while said elevator is in the lowered position;

during operation at least one case being allowed to move into position over said elevator while said elevator is in the lowered position, said elevator subsequently being raised to the raised position before said loading gate is opened to drop articles into the at least one case, and said elevator subsequently being lowered to the lowered position to allow a loaded case to exit via the downstream end of said loading station.

13. The case loader of claim 12, which further comprises a plurality of loading gate article sensors corresponding to the plurality of lanes to individually sense the presence of articles at the opposite end of said loading gate in each of the plurality of lines and employed to ensure that articles are in position on said loading gate in all of the plurality of lines before opening said loading gate to drop articles into the at least one case.

14. The case loader of claim 12, wherein said article brake comprises a vertically driven article stop which descends to block the passage of articles in all of the lanes.

15. A case loader for forming arrays of articles and dropping the articles into a plurality of upwardly open cases at the same time, said case loader comprising:

a loading station having an upstream end and a downstream end, said loading station including a loading gate on which articles are supported prior to being dropped, said loading gate having an entry end and an opposite end, and an elevator having lowered and raised positions for positioning cases below said loading gate, said elevator being sized to support the plurality of cases;

an article supply conveyor including a moving belt on which articles are carried in a plurality of lanes and delivered to said loading station to be moved on to said loading gate;

an article brake for holding articles from said article supply conveyor short of said loading station, causing an accumulation of articles on said article supply conveyor and producing line pressure force urging articles towards said loading station;

a plurality of conveyor article sensors corresponding to the plurality of lanes employed to individually sense the presence of articles on said article supply conveyor in each of the plurality of lanes a predetermined distance upstream of said loading station to ensure that articles are present on said article supply conveyor the predetermined distance upstream in all of the plurality of lanes to develop sufficient line pressure force before releasing said article brake to allow articles to move onto said loading gate in a plurality of lines corresponding to the plurality of lanes via said loading gate entry end urged by line pressure force; and a case conveyor carrying and at least delivering cases to the upstream end of said loading station to be moved into position over said elevator while said elevator is in the lowered position;

a plurality of loading gate article sensors corresponding to the plurality of lanes to individually sense the presence of articles at the opposite end of said loading gate in each of the plurality of lines and employed to ensure that articles are in position on said loading gate in all of the plurality of lines before opening said loading gate to drop articles into the at least one case;

a case spacing brake for holding cases from said case conveyor short of said loading station;

a case stop for holding cases within said loading station in position over said elevator;

an array of case sensors employed to ensure that previously-loaded cases are sufficiently on their way exiting via the downstream end of said loading station before said case spacing brake is released to allow the plurality of cases to move into position over said elevator while said elevator is in the lowered position, employed to determine that the plurality of cases are at least nearly in position over said elevator before said case spacing brake is applied to hold subsequent cases short of said loading station, employed to ensure that the plurality of cases are in position over said elevator before said elevator is raised and before said loading gate is opened to drop articles into the plurality of cases, and employed to ensure the trailing end of the last of the plurality of cases has exited said loading station past said case stop before said case stop is engaged to hold the subsequent cases in position over said elevator;

during operation said case spacing brake being released to allow the plurality of cases to move into position over said elevator and to be held by said case stop while said elevator is in the lowered position, said elevator subsequently being raised to the raised position before said loading gate is opened to drop articles into the plurality of cases, said case stop subsequently being released, said elevator subsequently being lowered to the lowered position, and the plurality of cases being allowed to exit via the downstream end of said loading station.

16. The case loader of claim 15, which further comprises an elevator sensor employed to ensure said elevator is in the raised position before said loading gate is opened.

* * * * *